US005415844A

United States Patent [19]

Moore

[11] Patent Number: 5,415,844

[45] Date of Patent: May 16, 1995

[54] TRAY, PARTICULARLY FOR USE WITH CERAMIC WARE

[75] Inventor: William H. Moore, Elk Grove Village, Ill.

[73] Assignees: Edward F. Barbeau; Marianne T. Barbeau, both of Glen Ellyn, Ill.

[21] Appl. No.: 103,096

[22] Filed: Aug. 9, 1993

[51] Int. Cl.[6] ..... B01L 3/00; B05C 13/00

[52] U.S. Cl. ..... 422/104; 118/501; 206/561

[58] Field of Search ..... 118/501; 422/104; 206/557, 561

[56] References Cited

U.S. PATENT DOCUMENTS

| | | | |
|---|---|---|---|
| 508,449 | 11/1893 | Tortat | 206/561 |
| 4,169,532 | 10/1979 | Scapellati | 206/561 |
| 4,616,748 | 10/1986 | Thomas et al. | 206/557 |
| 5,078,090 | 1/1992 | Richman | 118/501 X |

*Primary Examiner*—Jeffrey R. Snay
*Attorney, Agent, or Firm*—Marshall, O'Toole, Gerstein, Murray & Borun

[57] ABSTRACT

A tray assembly comprising a bottom tray, a support grid, and a top screen. The bottom tray includes a generally flat bottom wall having an upturned side, the side forming a ledge. The outer contour of the grid is similar to that of the ledge and the ledge supports the outer periphery of the grid, the grid extending across the flat bottom. The top screen comprises a flat screen and a border member around the periphery of the screen, the border member being secured to the screen and removably attached to the upturned side of the bottom tray. When assembled, the top screen is supported by the grid and the grid is supported by the bottom tray, and a piece of greenware to be cleaned is placed on the top screen. Scrapings from the greenware fall through the screen and the grid and into the bottom tray. After the piece has been cleaned and bisque fired, a person may turn the tray upside down and place the piece on what is normally the underside of the bottom tray. In this position, the person may apply a coating to the piece, and a trough or recess around the periphery of the bottom tray retains any excess coating. The bottom tray has static electricity which attracts the dust.

7 Claims, 3 Drawing Sheets

TRAY, PARTICULARLY FOR USE WITH CERAMIC WARE

FIELD AND BACKGROUND OF THE INVENTION

This invention relates to a multiple function tray assembly, particularly for use by persons working with ceramic greenware and/or porcelain.

The steps involved in making ceramic ware include shaping a quantity of clay, allowing the clay to dry and form a relatively hard body referred to as greenware, firing the greenware to form a rigid bisque ware, applying a coat of stain, coloring and/or glaze to the bisque ware and firing again to fuse the coat with the clay.

A piece of greenware is usually cleaned and further shaped by hand. For example, a hobbyist in a pottery shop or at home may scrape the surface of the piece to smooth it or remove imperfections, and often a folded screen is used as a scraper. A typical piece has a bottom or base, and the base is scraped to produce a flat bottom surface.

As a result of the above scraping, the hobbyist or worker is frequently surrounded by fine clay dust which is difficult to control or gather.

As mentioned above, after the desired shape has been achieved and the piece of greenware has been fired, a coating of some kind is usually applied to the bisque ware. The coating is a rather thin liquid which is applied using a brush. This gives rise to another unsatisfactory situation because some of the coating often runs off the ware or drips from the brush. For a home hobbyist, for example, this can be an annoyance.

It is therefore a general object of the present invention to provide an improved tray assembly which collects clay dust when cleaning greenware, forms a flat screen surface which is useful in shaping the greenware, and may be used when applying a coating to a piece.

SUMMARY OF THE INVENTION

A tray assembly constructed in accordance with this invention comprises a bottom tray, a support grid, and a top screen. The bottom tray includes a generally flat bottom wall having an upturned side, the side forming a ledge. The outer contour of the grid is similar to that of the ledge and the ledge supports the outer periphery of the grid, the grid extending across the flat bottom. The top screen comprises a flat screen and a border member around the periphery of the screen, the border member being secured to the screen and removably attached to the upturned side of the bottom tray. When assembled, the top screen is supported by the grid and the grid is supported by the bottom tray, and a piece of greenware to be cleaned is placed on the top screen. Scrapings from the greenware fall through the screen and the grid and into the bottom tray. After the piece has been cleaned and bisque fired, a person may turn the tray upside down and place the piece on what is normally the underside of the bottom tray. In this position, the person may apply a coating to the piece, and a trough or recess around the periphery of the bottom tray retains any excess coating.

BRIEF DESCRIPTION OF THE DRAWINGS

The invention will be better understood from the following detailed description taken in conjunction with the accompanying figures of the drawings, wherein.

DETAILED DESCRIPTION OF THE INVENTION

Figure 1:
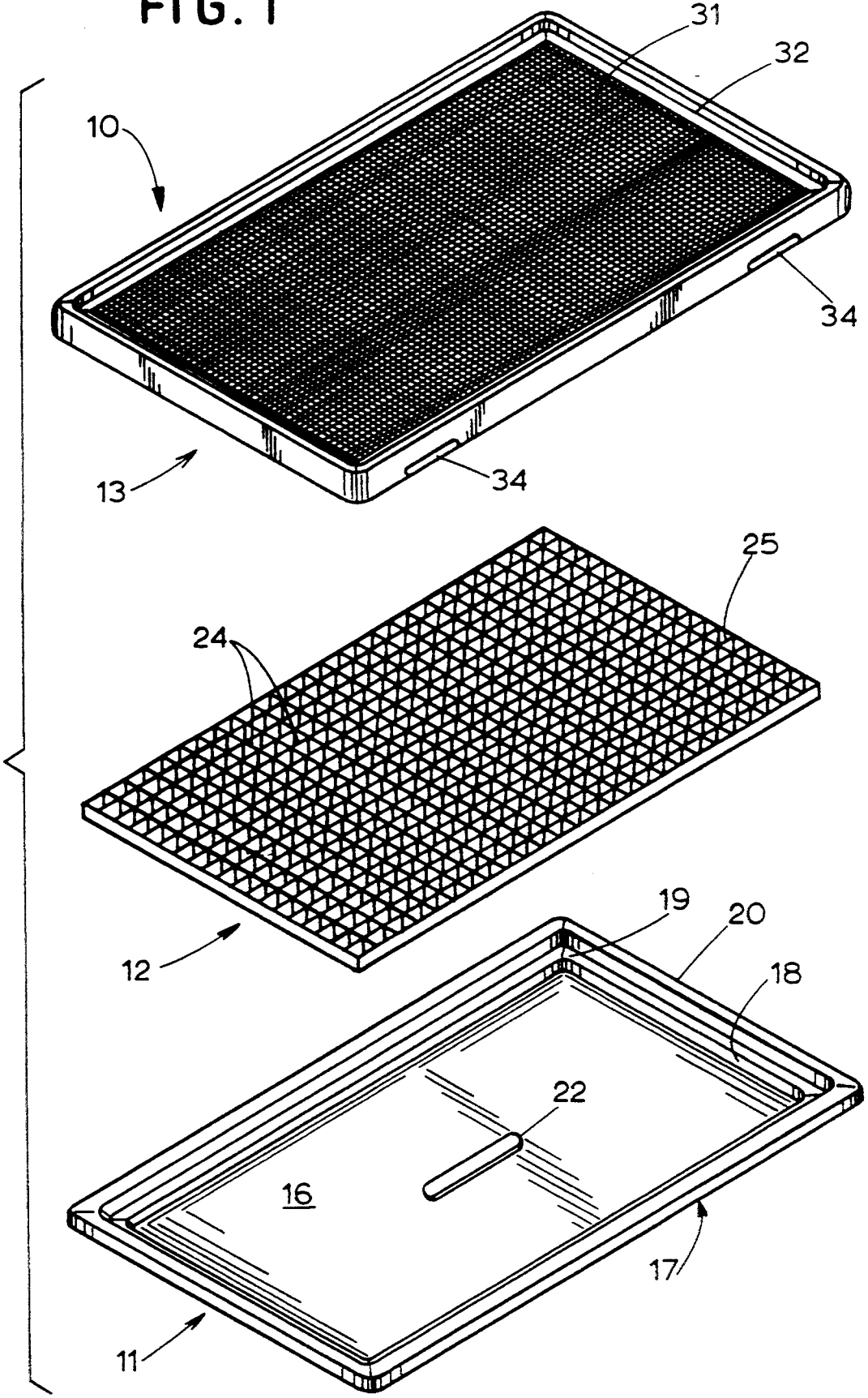
FIG. 1 is an exploded perspective view of a tray assembly constructed in accordance with the invention.
Figure 2:
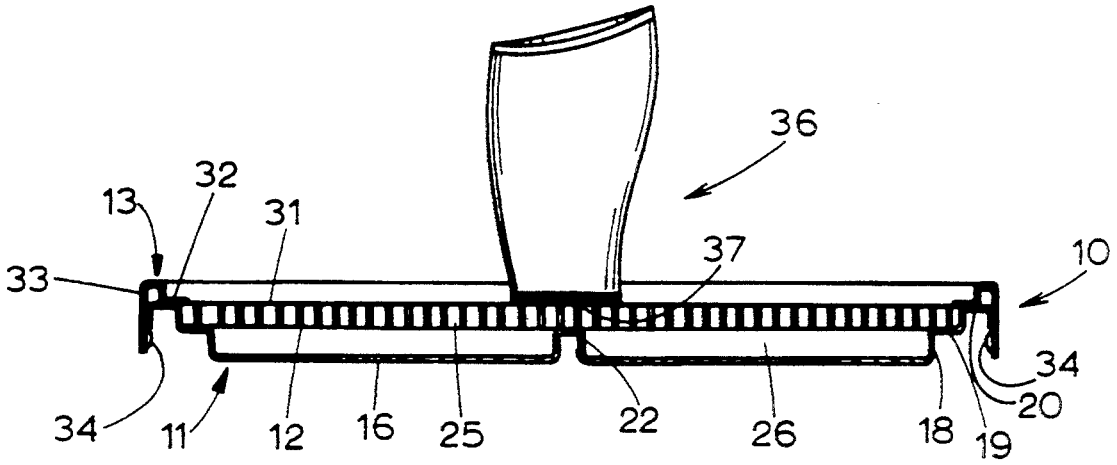
FIG. 2 is a sectional view showing the tray in use during cleaning of a piece of greenware.

With reference first to FIGS. 1 and 2, a tray assembly 10 constructed in accordance with the invention comprises a bottom tray 11, a support grid 12, and a top screen 13. The three parts are separately formed and are assembled before use when cleaning a piece of greenware.

The bottom tray 11 is formed of a relatively firm molded plastic and includes a generally flat bottom wall 16 which, in the present specific example, is rectangular in plan view. Extending upwardly around the periphery of the bottom wall 16 is a raised side 17 which is formed integrally with the wall 16. When the bottom tray 11 is positioned as shown in FIG. 2, the side 17 includes a vertical portion 18 that extends upwardly from the bottom wall 16, a ledge 19 which extends horizontally outwardly from the portion 18, and an arcuate part 20 which curves upwardly, then outwardly, and then downwardly. The side 17 adds rigidity to the bottom wall 16, supports the grid 12, and connects with the top screen 13. In the center area of the bottom wall 16 is at least one upwardly extending support ridge 22 which provides added support for the grid 12.

The grid 12 is also integrally formed of a relatively firm plastic and includes two sets of closely spaced ribs 24. In the present specific example, one set of the ribs 21 extends parallel to the long dimension of the bottom tray 11 and the other set of the ribs extends perpendicularly to the first set. The spaced ribs form a plurality of openings or passages 25 which extend vertically from the top screen 13 to the bottom wall 16.

The outer contour of the grid 12 also forms a rectangle having the dimensions of the ledge 19, and as shown in FIG. 2, the outer periphery of the grid 12 rests on the ledge 19 and is within or confined by the arcuate part 20. The center area of the grid is spaced from the bottom wall 16, thereby forming a collection space 26 between the grid and the bottom wall. The ridges 22 have the same height as the ledge 19 and engage the underside of the center area of the grid 12, and thus support the center area.

The top screen 13 comprises a screen 31 and an outer border or frame member 32 which extends around and is secured to the outer periphery of the screen 31. The screen 31 is also rectangular and has generally the same dimensions as the grid 12. The border member 32 has generally the same size as (but is slightly larger than) the arcuate part 20, so that the border member 32 may be placed over and clipped onto the arcuate part 20. The border member 32 preferably is provided with a raised rim portion 33 which extends upwardly from the screen 31, the rim portion adding rigidity to the top screen 13 and serving to prevent dust from spilling off the upper surface of the screen 31. The border member 32 is made of a rather thin pliable plastic, and it may be deformed sufficiently to enable it to be clipped over or removed from the arcuate part 20. Inwardly extending protrusions 34 are formed near the lower edge of the border member 32, the protrusions extending inwardly under the lower edge of the side 17 and forming catches which releasably hold the top screen assembled with the bottom tray.

The screen 31 is preferably made of a material which will not contaminate or color the ceramic ware. It is preferably made of relatively close mesh, strong wires or filaments of aluminum. The periphery of the screen is preferably secured to the border member 32 by adding a solvent to a quantity of plastic of the same type as the border member 32 to form a slurry, positioning the screen with its outer periphery overlying the underside of the border member 32, and applying the slurry to the overlapped area of the screen. The solvent penetrates and softens the surface of the border member 32, and when the solvent dries, the plastic of the slurry fuses to the border member and thus firmly secures the screen to the border member.

Before cleaning a piece of greenware 36 (FIG. 2), the grid 12 is positioned on the ledge 19 and the ridge 22, and the border member 32 of the screen part is clipped to the arcuate part 20 of the side 17. The screen 31 rests on and is supported by the upper side of the grid 12, and the piece 36 is placed on top of the screen 31. The weight of the piece 36 is supported by the grid 12 which, in turn, is supported by the ledge 19 and the ridge 22.

The person then scrapes and cleans the piece 36 using, for example, a folded section of screen material. To form a flat bottom side 37 on the piece 36, the worker simply moves the piece 36 back and forth across the top of the screen 31, and the screen 31, which is flat because it is supported on the flat upper side of the grid 12, functions as a scraper and produces a flat side 37. The ribs 24 forming the grid 12 are spaced sufficiently close together to hold the screen in a flat plane. As an example, a spacing of about one-half inch is satisfactory.

The above-described scraping of the greenware produces a substantial amount of clay scrapings and/or dust, and it is an important feature of this invention that the scrapings/dust move downwardly and pass through the screen 31 and through the passages 25 formed by the grid 12. The dust collects on the bottom wall within the bottom tray 11 and it is retained there until the worker has finished cleaning the piece 36. The tray may then be cleaned by removing the screen part 13 and the grid 12 and dumping the dust into a suitable container.

If dust and/or clumps of clay tend to collect on top of the screen 31, the worker may simply rub the dust and clumps against the screen 31 to push them through. Once under the screen, the dust is unlikely to be disturbed by air currents in the room because the screen 31 and the grid 12 act as shields which keep the air currents away from the dust. Further, the tray bottom 11 is preferably molded of high impact polystyrene with a high gloss, and this plastic material develops a static electric charge which attracts and holds the dust at the bottom of the tray.

Figure 3:
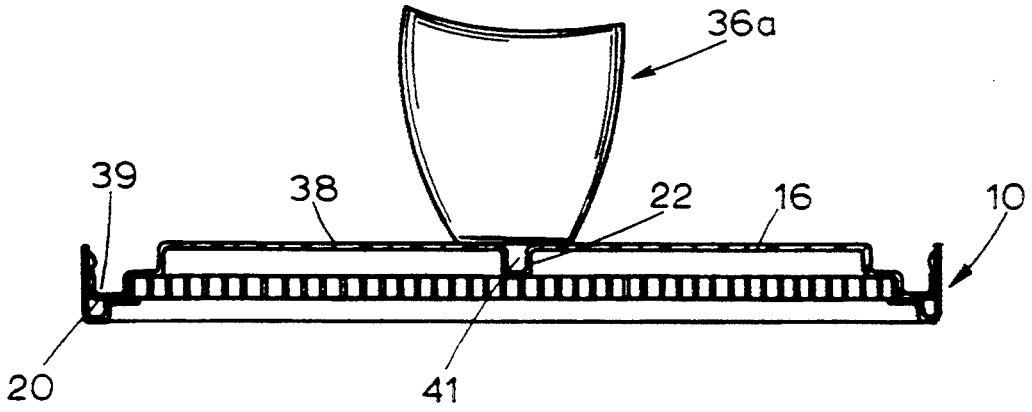
FIG. 3 is a side view showing the tray in use during staining or coloring a piece.

After the piece 36 of greenware has been cleaned, it is fired and normally the resulting bisque ware is coated with a coloring of some kind. At this stage the tray 10 (after the clay dust has been removed) is turned upside down as shown in FIG. 3 and a piece **36*a* is placed on the bottom surface 38 which is normally the underside of the wall 16. Any drips or running of the coating falls on the surface 38. The arcuate portion 20 at the periphery of the bottom tray 11 forms a trough or recess 39 when the tray is turned over, and the trough catches any coloring. The ridge 22 also forms a recess 41 in the underside of the bottom tray 11 which hold excess coloring. The high gloss polystyrene is easily cleaned of the coloring. The bottom tray 11 alone may be used at this time, but it is preferred that the entire assembly of the parts 11, 12 and 13** be used.

Figure 4:
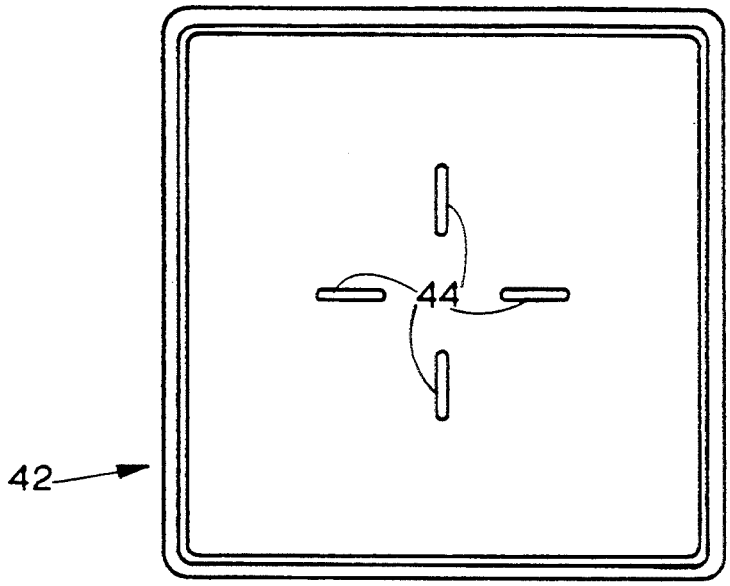
FIGS. 4 and 5 show alternative tray constructions.
Figure 5:
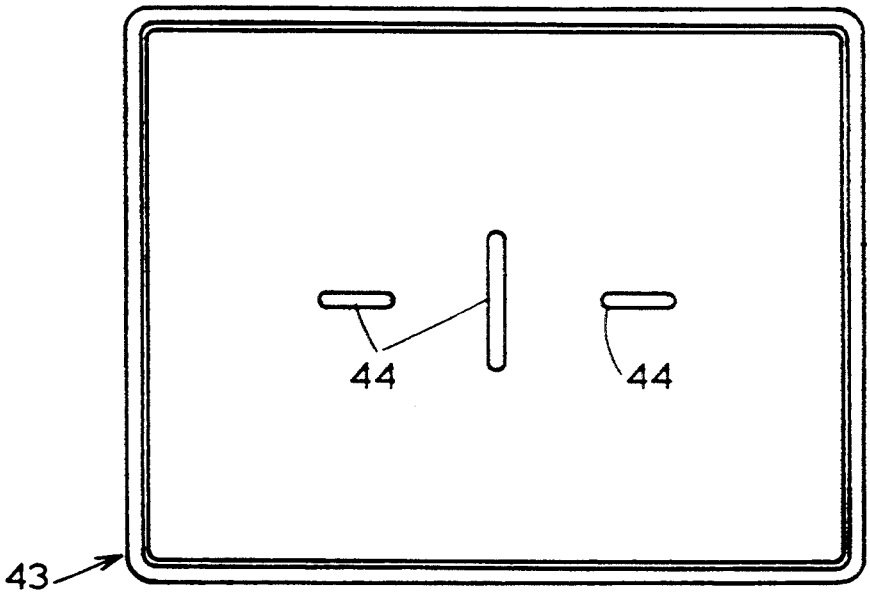

FIGS. 4 and 5 illustrate slightly different configurations of bottom trays 42 and 43 which are essentially the same as the bottom tray 11 except for the length-width proportions. The arrangements of the ridges 44 of the bottom wall may also be different, provided that they give adequate support to the center area of the grid and the screen. The tray assembly could also have configurations other than rectangular or square, such as round, oval, etc. In a relatively small size tray assembly, the support ridges may be eliminated. The bottom trays 42 and 43, of course, are used with grids and screens as previously described, sized and shaped to match the trays 42 and 43.

Both the bottom tray 11 and the border 32 are preferably made of high impact polystyrene having a high gloss. The grid 12 is preferably made of polystyrene, and the screen 31 is preferably made of aluminum.

It will be apparent from the foregoing that a novel and improved product has been provided. The tray collects and retains clay dust which might otherwise circulate and settle in the working environment. In addition to collecting dust, the screen of the top screen part may be used to clean and/or shape a piece of greenware, and the underside of the tray may be used when placing a glaze or coloring on a piece. The high gloss polystyrene is easy to clean and it develops static electricity which attracts dust.

What is claimed is:

1. A tray assembly comprising a tray part including an imperforate substantially flat bottom and a side which extends upwardly around the periphery of said flat bottom, a flat screen spaced from and extending across said flat bottom, said flat screen extending substantially to said side, and a grid between said flat bottom and said flat screen, said grid including a substantially flat support surface which engages and supports said screen, said grid forming a plurality of passages which extend from said screen toward said flat bottom, and fastening means for connecting said screen with said tray part for holding said screen and said grid assembled with said tray part, said side forming a ledge which is spaced from said flat bottom, and said grid includes an outer periphery which rests on said ledge, whereby said grid is spaced from said flat bottom, said tray part being formed of a plastic material that develops a static electric charge which attracts dust and other particles, and said side and said substantially flat bottom forming a trough on the underside thereof, whereby said tray can be positioned upside down with said flat bottom facing upwardly, and said trough surrounding said flat bottom.

2. A tray assembly, as set forth in claim 1, wherein at least one ridge is formed on said flat bottom and extends toward said grid, said ridge engaging and supporting said grid.

3. A tray assembly, as set forth in claim 1, and further including a border which extends around said screen, said border being made of plastic, and fusing means for securing said screen to said border.

4. A tray assembly as set forth in claim 1, wherein said material is polystyrene with a gloss.

5. A tray assembly as set forth in claim 1, wherein said grid includes a plurality of integrally formed ribs.

6. A tray assembly, as set forth in claim 1, wherein said fastening means comprises a border secured to said screen, said border overlying and releasably coupling with said side.

7. A tray assembly as set forth in claim 6, wherein said border includes a raised rim portion which extends upwardly from said flat screen.

* * * * *